US009074830B2

(12) United States Patent
Moll et al.

(10) Patent No.: US 9,074,830 B2
(45) Date of Patent: Jul. 7, 2015

(54) DRIVING APPARATUS FOR ONE OR MORE CLEANING LANCES

(75) Inventors: Frank Joseph Moll, Canton, OH (US); Donald Gary Ramsey, Youngstown, OH (US)

(73) Assignee: Hydrochem LLC, Atlanta, GA (US)

( * ) Notice: Subject to any disclaimer, the term of this patent is extended or adjusted under 35 U.S.C. 154(b) by 432 days.

(21) Appl. No.: 12/905,526

(22) Filed: Oct. 15, 2010

(65) Prior Publication Data

US 2011/0155174 A1 Jun. 30, 2011

Related U.S. Application Data

(60) Provisional application No. 61/251,985, filed on Oct. 15, 2009, provisional application No. 61/304,618, filed on Feb. 15, 2010.

(51) Int. Cl.

| | |
|---|---|
| ***F28G 1/16*** | (2006.01) |
| ***F28G 15/04*** | (2006.01) |
| ***B08B 9/027*** | (2006.01) |
| ***B08B 9/043*** | (2006.01) |

(52) U.S. Cl.

CPC ..... *F28G 15/04* (2013.01); *B08B 9/027* (2013.01); *B08B 9/043* (2013.01); *F28G 1/163* (2013.01)

(58) Field of Classification Search

CPC ..... F28G 15/04; F28G 1/163; B08B 9/0323
USPC ..... 134/8, 22.11, 167 C; 226/1, 188
See application file for complete search history.

(56) References Cited

U.S. PATENT DOCUMENTS

| | | | | |
|---|---|---|---|---|
| 2,262,364 | A | | 11/1941 | Hugel et al. |
| 2,971,699 | A | | 2/1961 | Reiss |
| 3,269,659 | A | | 8/1966 | Shelton et al. |
| 3,389,713 | A | | 6/1968 | Pittman |
| 3,448,477 | A | | 6/1969 | Ricordeau et al. |
| 3,882,565 | A | * | 5/1975 | Irwin et al. ..... 15/104.33 |
| 3,903,912 | A | * | 9/1975 | Ice et al. ..... 134/167 C |
| 3,938,535 | A | * | 2/1976 | Cradeur et al. ..... 134/167 C |
| 4,095,305 | A | | 6/1978 | Goodwin |
| 4,509,544 | A | | 4/1985 | Mains, Jr. |
| 4,691,723 | A | * | 9/1987 | Mierswa et al. ..... 134/167 C |
| 4,716,611 | A | | 1/1988 | Barry |
| 5,022,463 | A | | 6/1991 | Boisture |

(Continued)

FOREIGN PATENT DOCUMENTS

| | | | |
|---|---|---|---|
| DE | 102005020658 | A1 * | 2/2006 |
| EP | 0162309 | | 11/1985 |

OTHER PUBLICATIONS

Kamper, J., Derwent abstract for DE 202004009218, Oct. 7, 2004.*

(Continued)

*Primary Examiner* — Michael Kornakov
*Assistant Examiner* — Natasha Campbell
(74) *Attorney, Agent, or Firm* — Seyfarth Shaw LLP

(57) ABSTRACT

A driving apparatus can be utilized to control the cleaning movements of one or more cleaning lances with respect to certain industrial equipment such as a heat exchanger. For example, driving apparatus can be utilized to feed an additional length of cleaning lance to the tubes of exchanger, or to retract cleaning lance from the tubes of exchanger as desired. In general, driving apparatus can be used to clean a variety of types of pipes, tubing and equipment used in industrial facilities.

18 Claims, 12 Drawing Sheets

(56) References Cited

U.S. PATENT DOCUMENTS

| | | | | |
|---|---|---|---|---|
| 5,065,703 | A | 11/1991 | Lee | |
| 5,103,847 | A | 4/1992 | Martin et al. | |
| 5,129,455 | A | 7/1992 | Boisture | |
| 5,261,600 | A | 11/1993 | Cradeur | |
| 5,322,080 | A * | 6/1994 | Rankin | 134/167 C |
| 5,499,639 | A | 3/1996 | Williams, Jr. | |
| 5,555,851 | A | 9/1996 | Vandenberg | |
| 5,561,883 | A | 10/1996 | Landry et al. | |
| 5,640,982 | A | 6/1997 | Landry et al. | |
| 5,642,745 | A | 7/1997 | Landry et al. | |
| 5,649,523 | A | 7/1997 | Scott | |
| 5,740,821 | A | 4/1998 | Arnold | |
| 5,839,613 | A * | 11/1998 | Marcout et al. | 226/176 |
| 6,681,839 | B1 | 1/2004 | Balzer | |
| 6,757,932 | B1 | 7/2004 | Verstraeten | |
| 2002/0104215 | A1 * | 8/2002 | Tokunaga et al. | 29/890.038 |
| 2004/0006841 | A1 | 1/2004 | Jameel | |
| 2006/0185691 | A1 | 8/2006 | Joseph | |
| 2006/0260652 | A1 * | 11/2006 | Kruse | 134/22.1 |
| 2008/0185126 | A1 | 8/2008 | Jiang et al. | |
| 2009/0255557 | A1 | 10/2009 | Gardner | |

OTHER PUBLICATIONS

Powerpoint Presentation—HydroChem Capabilities Presentation—May 9, 2008.

Powerpoint Presentation—HydroChem STARS Project—Oct. 24, 2007.

Powerpoint Presentation—HydroChem Managed Services Presentation—May 8, 2008.

TLE Machine—Mourik Magazine, No. 33—Jan. 2005—Joh. Mourik & Co. Holding B.V., P.O. Box 2, NL-2964 ZG Groot-Ammers.

URACA Heat Exchanger Cleaning Brochure—URACA Pumpenfabrik GmbH & Co. KG—Jan. 2000—Available on Internet website www.uraca.de.

PCT/US 2009/001764 Annex to Form PCT/ISA/206 Communication Relating to the Results of the Partial International Search, Mailed Mar. 3, 2011.

PCT/US2010/052838—International Search Report, Mailed Feb. 3, 2011.

* cited by examiner

DRIVING APPARATUS FOR ONE OR MORE CLEANING LANCES

RELATED APPLICATIONS

This Application claims the benefit, and priority benefit, of U.S. Provisional Patent Application Ser. No. 61/251,985, filed Oct. 15, 2009, entitled "Driving Apparatus for Heat Exchanger Tube Cleaning Lance," and U.S. Provisional Patent Application Ser. No. 61/304,618, filed Feb. 15, 2010, entitled "Driving Apparatus for One or More Heat Exchanger Tube Cleaning Lances," both of which are incorporated herein in their entireties.

BACKGROUND

1. Field

This subject matter relates generally to the cleaning of industrial equipment, and more particularly, to an apparatus for controlling the movement of one or more lances for cleaning heat exchangers, piping, tubing and other equipment found in industrial facilities.

2. Description of the Related Art

Heat exchangers are used in industrial facilities. Over time, these heat exchangers tend to develop residue on the surfaces of the tubes, tube sheets, tube support plates and other internal structural parts. This residue can have an adverse affect on the operational performance of the exchangers. The same problem can arise for piping, tubing and other equipment found in industrial facilities. A cleaning method for this equipment involves the controlled application of high pressure water and/or chemical streams to the affected areas of the equipment. One or more cleaning lances can be utilized to supply the high pressure water and/or chemical streams to the equipment.

SUMMARY

In accordance with the illustrative embodiments hereinafter described, an apparatus for advancing a cleaning lance is provided. The apparatus can include a drive unit having one or more drive wheels disposed thereon, an idler unit having one or more idler wheel disposed thereon, an opening between the drive wheels and the idler wheels such that the cleaning lance is positionable in the opening, a contact surface on the idler wheels for contacting the cleaning lance and applying pressure to the cleaning lance, and a contact surface on the drive wheels for contacting the cleaning lance and applying frictional force to the cleaning lance such that the cleaning lance is advanced upon rotational movement of the drive wheel.

The apparatus can further include at least one channel formed in the drive wheel for engaging the cleaning lance. The channel can include a pair of retaining walls forming an angle therebetween. The channel can also include a single curved, circumferential wall. The idler unit can be adjustable between an elevated position and a lowered position, whereby the cleaning lance sits in the opening between the drive wheels and the idler wheels when the idler unit is in the elevated position, and the drive wheels and the idler wheels contact the cleaning lance when the idler unit is in the lowered position.

A method of advancing a cleaning lance is also provided. A plurality of drive wheels are provided which are capable of rotational movement, the drive wheels each having a contact surface. A plurality of idler wheels are also provided which are capable of rotational movement, the idler wheels each having a contact surface. The cleaning lance is contacted with the contact surface of the idler wheels and pressure is applied to the cleaning lance. The cleaning lance is also contacted with the contact surface of the drive wheels and frictional force is applied to the cleaning lance such that the cleaning lance is advanced upon rotational movement of the drive wheels.

The drive wheels and/or idler wheels can display certain desired grip and slip properties with respect to the cleaning lance. For example, the drive wheels and/or idler wheels can grip the cleaning lance firmly enough to promote movement of the cleaning lance through the driving apparatus, but also, the drive wheels and idler wheels can slip with respect to the cleaning lance if the forward or reverse movement of cleaning lance somehow becomes restricted due to resistance in the equipment being cleaned.

In an illustrative embodiment, a method of removing an obstruction in a heat exchanger tube using a cleaning lance is provided. One or more drive wheels are provided which are capable of rotational movement. The drive wheels each have a contact surface thereon. A contact surface of the cleaning lance is contacted or engaged with the contact surfaces of the drive wheels. Frictional force is applied to the contact surface of the cleaning lance upon rotational movement of the drive wheels, such that the contact surfaces of the drive wheels grip the contact surface of the cleaning lance and the cleaning lance is advanced towards the obstruction in the heat exchanger tube. The obstruction in the heat exchanger tube is engaged, meaning, for example, that the cleaning lance either contacts the obstruction or delivers water or cleaning fluid to the obstruction. The rotational movement of the drive wheels is continued while the cleaning lance engages the obstruction, such that the contact surfaces of the drive wheels slip against the contact surface of the cleaning lance while the obstruction is removed or substantially removed from the heat exchanger tube. When these contact surfaces slip against each other, the surfaces are not torn or otherwise damaged. After cleaning is complete, frictional force is applied to the cleaning lance upon rotational movement of the drive wheels such that the contact surfaces of the drive wheels regrip the contact surface of the cleaning lance and the cleaning lance is moved with respect to the heat exchanger tube.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the subject matter defined by the appended claims.

DETAILED DESCRIPTION

Figure 1:
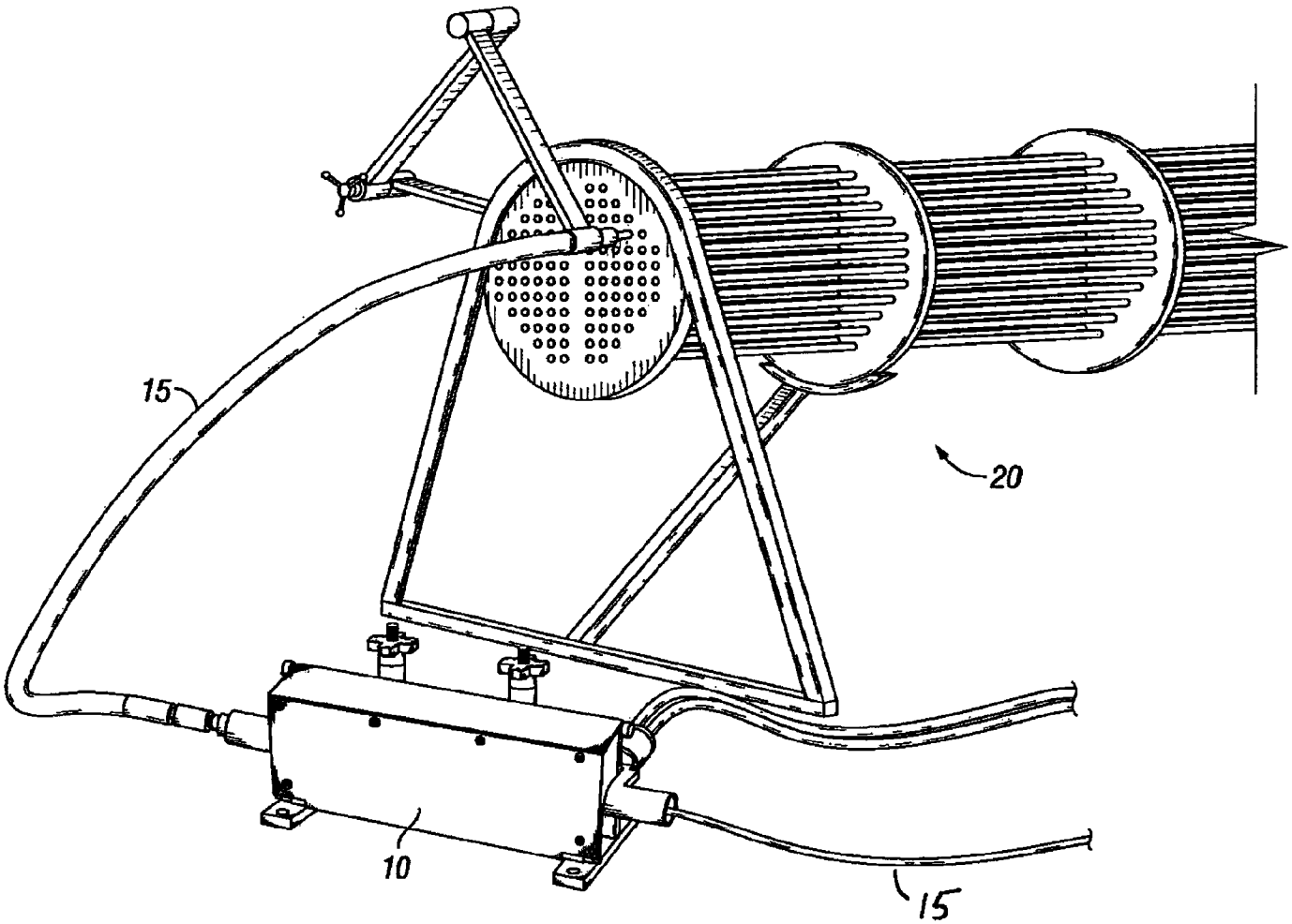
FIG. 1 is a front perspective view of a driving apparatus used to clean heat exchanger tubes in an illustrative embodiment.

Referring now to FIGS. 1-9, illustrative embodiments of a driving apparatus 10 are provided. In certain of the illustrative embodiments, for example, as shown in FIG. 1, driving apparatus 10 can be utilized to control the cleaning movements of one or more cleaning lances 15 with respect to certain industrial equipment such as a heat exchanger 20. For example, driving apparatus 10 can be utilized to feed an additional length of cleaning lance 15 to the tubes of exchanger 20, or to retract cleaning lance 15 from the tubes of exchanger 20 as desired. In general, driving apparatus 10 can be used to clean a variety of types of pipes, tubing and equipment used in industrial facilities.

Figure 2:
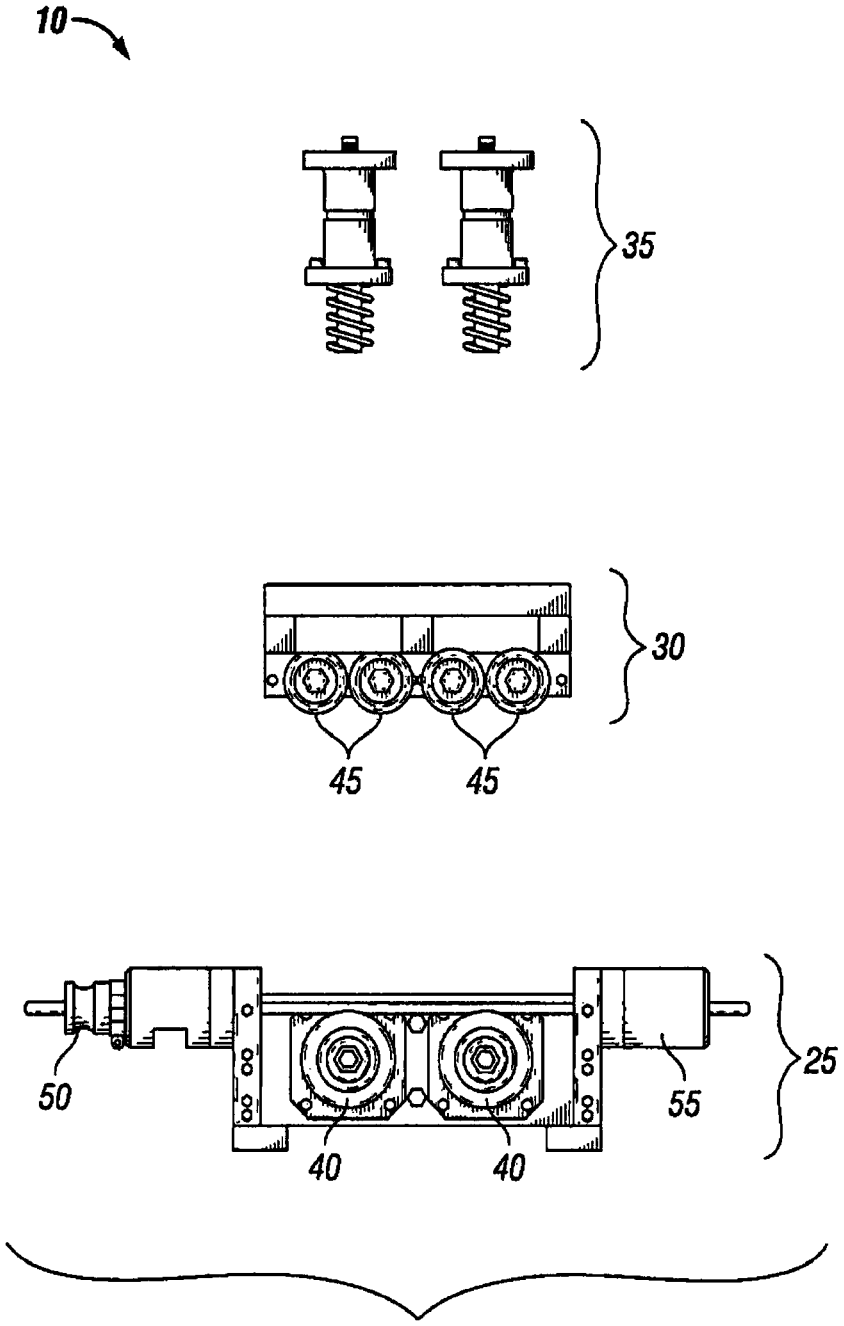
FIG. 2 is an exploded view of a driving apparatus in an illustrative embodiment.
Figure 3A:
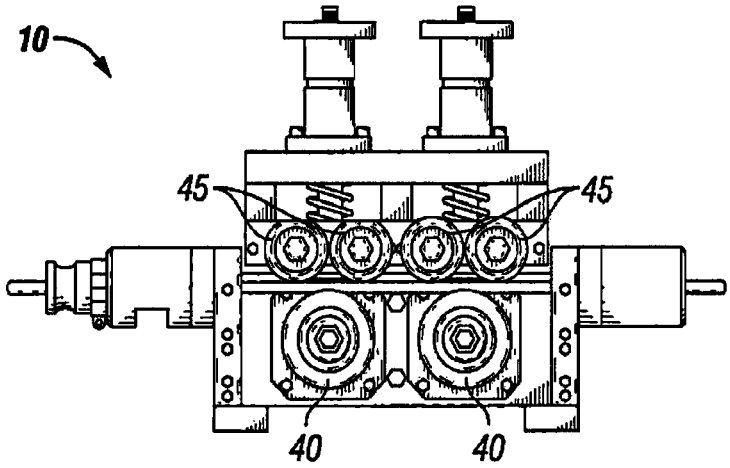
FIG. 3A is a front view of a driving apparatus having two drive wheels in an illustrative embodiment.
Figure 3B:
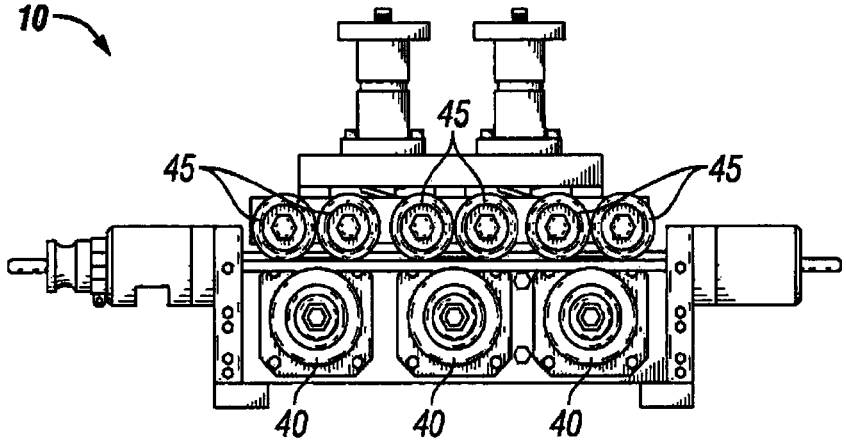
FIG. 3B is a front view of a driving apparatus having three drive wheels in an illustrative embodiment.
Figure 3C:
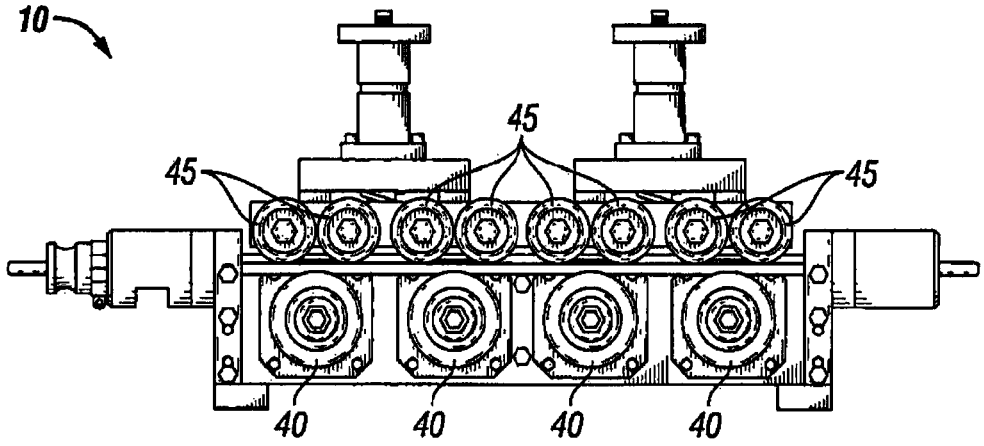
FIG. 3C is a front view of a driving apparatus having four drive wheels in an illustrative embodiment.

In an illustrative embodiment as illustrated in FIG. 2, driving apparatus 10 can comprise a plurality of units, such as a drive unit 25, an idler unit 30 and one or more adjustment units 35. Drive unit 25 can include one or more drive wheels 40. Drive wheels 40 can preferably rotate in either a clockwise or counterclockwise direction, as desired. The rotational movement of drive wheels 40 can be powered by, for example, a motor, an electrical power source, or any other power source as would be understood by one of ordinary skill in the art. In a preferred embodiment, a user of driving apparatus 10 can adjust and/or control the rotational speed of drive wheels 40 (in RPMs or other suitable units) as desired. In the embodiments shown in FIGS. 3A, 3B and 3C, two, three and four drive wheels 40 are utilized, respectively; however, any number of drive wheels 40 can be utilized in accordance with the present illustrative embodiments.

Idler unit 30 can include one or more idler wheels 45. Idler wheels 45 can preferably rotate in either a clockwise or counterclockwise direction, as desired. Idler unit 30 can be positioned adjacent to drive unit 25 (See FIGS. 3A-3C). In a preferred embodiment, each drive wheel 40 has at least two idler wheels 45 positioned adjacent thereto. In the embodiments shown in FIGS. 3A, 3B and 3C, four, six and eight idler wheels 45 are utilized, respectively; however, any number of idler wheels 45 can be utilized in accordance with the present illustrative embodiments.

Figure 4:
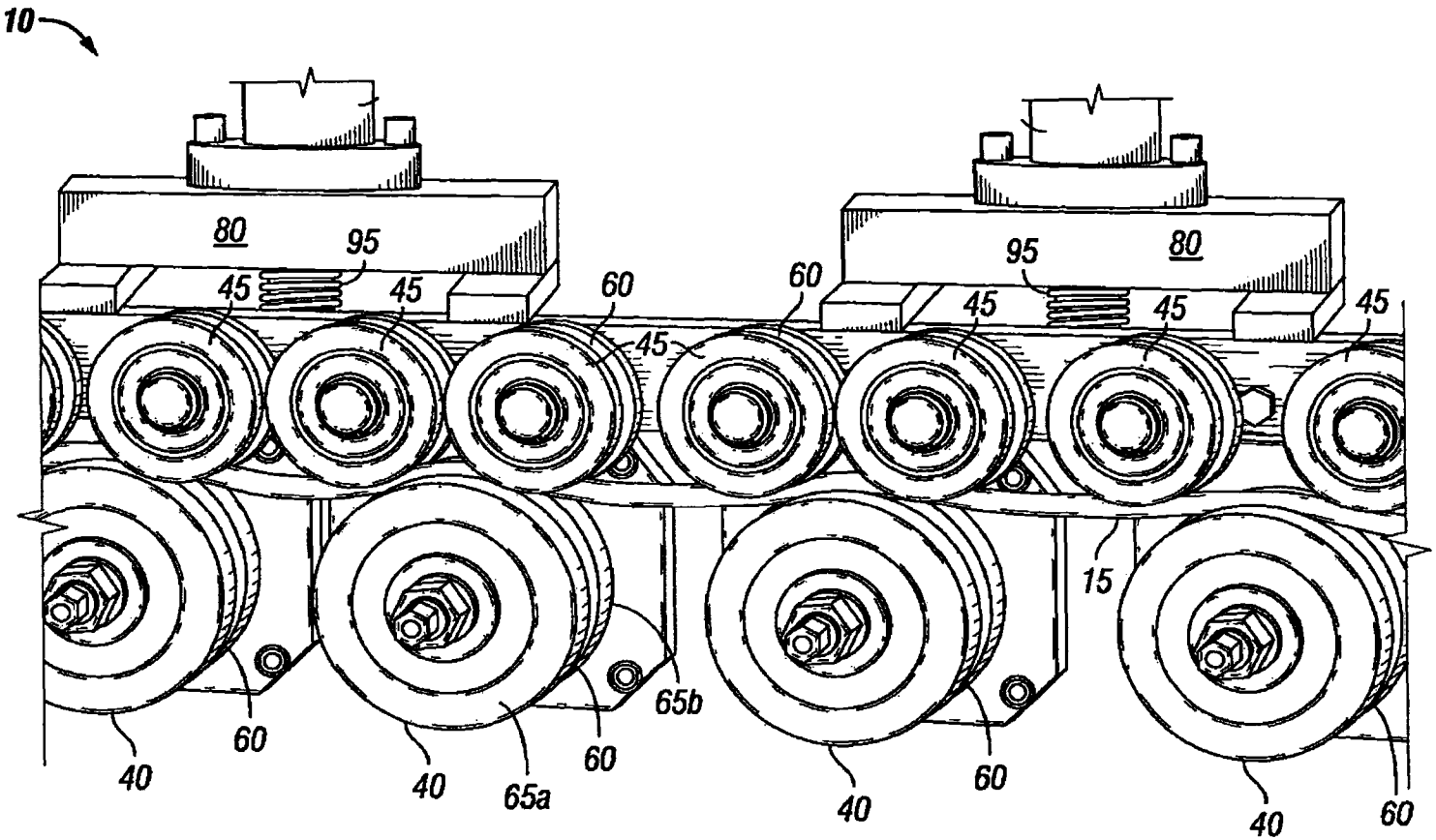
FIG. 4 is a front perspective view of a driving apparatus having four drive wheels in an illustrative embodiment.

As illustrated in FIG. 4, cleaning lance 15 can be disposed between drive wheels 40 and idler wheels 45 during operation of driving apparatus 10. In a preferred embodiment, a length of cleaning lance 15 can be interposed between drive wheels 40 and idler wheels 45 and the surface of lance 15 can directly contact the surface of both drive wheels 40 and idler wheels 45, such that both drive wheels 40 and idler wheels 45 can apply pressure to cleaning lance 15. Cleaning lance 15 can be rigid, semi-rigid or flexible, in various illustrative embodiments.

Preferably, there are two idler wheels 45 for each drive wheel 40. Idler wheels 45 and drive wheel 40 are preferably offset at approximately 15 degrees, although other offset angles can also be utilized. When pressure is applied to lance 15 by idler wheels 45 and drive wheel 40, the idler wheels 45 can force lance 15 on a slight radius around the top section of drive wheel 40. Having two idler wheels 45 offset from one drive wheel 40 can provide 4 to 5 times the surface area contact than having one idler wheel 45 pushing from directly overhead, in certain illustrative embodiments. As illustrated in FIG. 4, there can be a slight bend in lance 15 around drive wheel 40 when pressure is applied by idler wheels 45. If there is too much bend in lance 15, it can restrict the linear movement of lance 15. In certain illustrative embodiments, idler wheels 45 can bottom out with respect to drive wheel 40 to prevent overtightening and wrapping lance 15 too far around drive wheel 40 which would inhibit drive.

In certain illustrative embodiments, the rotational movement of idler wheels 40 is not directly powered by a motor, an electrical power source, or any other power source. Instead, the rotational movement of idler wheels 40 results from their direct contact with cleaning lance 15. As cleaning lance 15 contacts drive wheels 40 and is advanced or retracted through apparatus 10 due to the rotational movement of drive wheels 40, lance 15 contacts idler wheels 45 and causes idler wheels 45 to rotate. Idler wheels 45 apply pressure to cleaning lance 15 and prevent cleaning lance 15 from being disengaged from drive wheels 40.

In certain illustrative embodiments, drive wheels 40 and/or idler wheels 45 can display certain desired grip and slip properties with respect to cleaning lance 15. For example, drive wheels 40 and/or idler wheels 45 can grip cleaning lance 15 firmly enough to promote movement of cleaning lance 15 through driving apparatus 10, but also, drive wheels 40 and idler wheels 45 can slip with respect to cleaning lance 15 if the forward or reverse movement of cleaning lance 15 somehow becomes restricted. For example, if cleaning lance 15 encounters a plug or restriction in a tube of heat exchanger 20 such that the lance 15 cannot advance forward, drive wheels 40 can continue to rotate, but will preferably slip over the surface of cleaning lance 15 so that cleaning lance 15 would not become entangled or otherwise damaged.

Figure 5A:
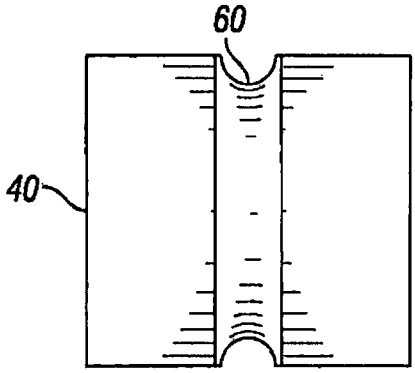
FIG. 5A is a side view of a drive wheel having a curved channel formed therein in an illustrative embodiment.
Figure 5B:
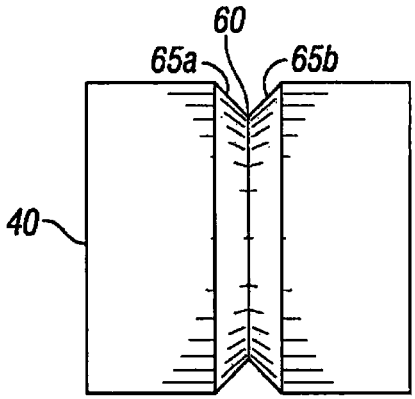
FIG. 5B is a side view of a drive wheel having a pair of retaining walls forming a v-shaped channel in an illustrative embodiment.
Figure 5C:
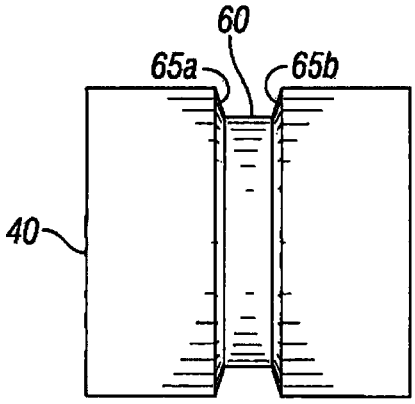
FIG. 5C is a side view of a drive wheel having a pair of retaining walls and a base forming a channel therein in an illustrative embodiment.

One or more grooves or channels 60 may be formed on the outer surface of the drive wheels 40 and/or idler wheels 45 of driving apparatus 10. As illustrated in FIGS. 5A-5C, channel 60 may have a variety of shapes. For example, channel 60 can have a concave, curved, circumferential shape (see FIG. 5A). Channel 60 can also have a pair of retaining walls 65*a* and 65*b* that meet at their lower end to form a V-shape having an angle therebetween in various illustrative embodiments (see FIG. 5B). Channel 60 may also have a pair of retaining walls 65*a* and 65*b* that do not meet at their lower end, but instead have a base and one or more additional walls positioned therebetween. (see FIG. 5C). Cleaning lance 15 can sit at least partially within channel 60, such that channel 60 holds and guides cleaning lance 15 as it is being advanced towards or away from exchanger 20.

The size of cleaning lance 15 may determine the shape of channel 60 that is preferably utilized. For example, for illustrative purposes only, a lance 15 having a relatively smaller size (for 2-5 inch pipes) may require a V-shaped channel, as only two contact points may be needed between cleaning lance 15 and drive wheels 40 and/or idler wheels 45 to provide the desired grip and slip properties. Alternatively, a lance 15 of relatively larger size (for 5-60 inch pipes) which can carry higher volumes of water and/or cleaning materials may require a curved, circumferential shaped channel, as more than two contact points may be needed between cleaning lance 15 and drive wheels 40 and/or idler wheels 45 to provide the desired grip and slip properties, such as increased grip when trying to advance or retract a high pressure line.

In general, driver assembly 10 is adjustable and can be utilized with a variety of sizes of cleaning lances 15, including but not limited to 1/16", 1/8", 1/4" and 9/16", without any unnecessary reassembly, exchanging of parts or mechanical changes. Channels 60 in drive wheels 40 and idler wheels 45 can contact various sizes of lances 15. For example, smaller size lances 15 can sit deeper in channel 60 and larger size lances 15 can fit higher up in channel 60. In an illustrative embodiment, channel 60 can be sized at 50 degrees to accommodate 1/8" to 9/16" flex lances. Further, drive wheels 40 preferably have enough stroke to handle various sizes of lances 15 in certain illustrative embodiments.

Drive wheels 40 and idler wheels 45 of driver assembly 10 can provide sufficient grip and pressure on cleaning lance 15 to advance or retract cleaning lance 15 while preventing unnecessary slippage. At the same time, the surfaces of drive wheels 40 and idler wheels 45 will not damage lance 15 when some minimal slippage and/or friction does occur, in certain illustrative embodiments. For example, drive wheels 40 and/or idler wheels 45 may be formed of compound rubber, polyethylene or other polymer material, or have a coating of such material formed thereupon.

In certain illustrative embodiments, driving apparatus 10 can feed a flexible lance 15 at speeds up to 30 inches per second. Drive wheels 40 can preferably slip when a nozzle end of lance 15 meets or contacts a plug in a tube of exchanger 20. By adjusting the tension on idler wheels 45, a user can control the thrust of lance 15 against a potential plug. As lance 15 works through the plug, lance 15 will continue to travel through the tube in exchanger 20 until the plug is removed and apparatus 10 can back up to desired full speed setting. Apparatus 10 can allow for control of slippage of lance 15 between drive wheels 40 and idler wheels 45 without damaging lance 15, and can provide enough grip so that lance 15 only slips when desired.

In certain illustrative embodiments (see FIGS. 6A-6C), cleaning lance 15 can enter driving apparatus 10 via a front hose guide 50, sit between drive wheels 40 and idler wheels 45, and exit driving apparatus 10 via a rear hose guide 55. Front hose guide 50 and rear hose guide 55 can preferably prevent cleaning lance 15 from moving out of position or otherwise becoming disengaged from driving apparatus 10 during operation.

Further, the position of idler unit 30 can be adjusted with respect to the position of drive unit 25. For example, the distance between drive wheels 40 and idler wheels 45 can be adjustably controlled by the user as desired. In an illustrative embodiment, idler unit 30 can be moved to a spaced apart, raised or open position (FIG. 6A) to allow cleaning lance 15 to be positioned between drive wheels 40 and idler wheels 45. Idler unit 30 can also be moved to an engaged together, lowered or closed position (FIG. 6B) to tighten and secure cleaning lance 15 between drive wheels 40 and idler wheels 45.

Figure 6A:
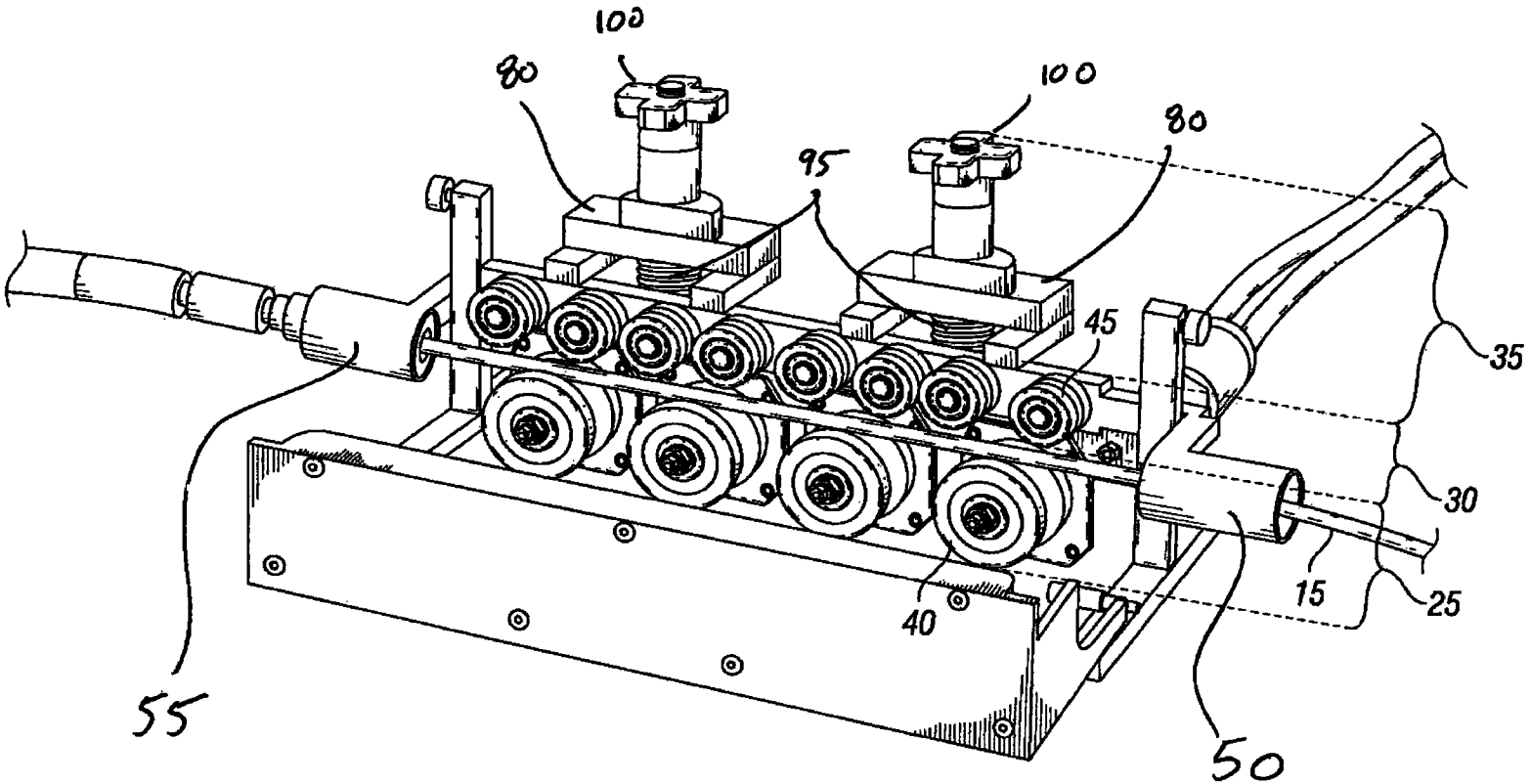
FIG. 6A is a front perspective view of a driving apparatus with the drive wheels and idler wheels spaced apart in an illustrative embodiment.
Figure 6B:
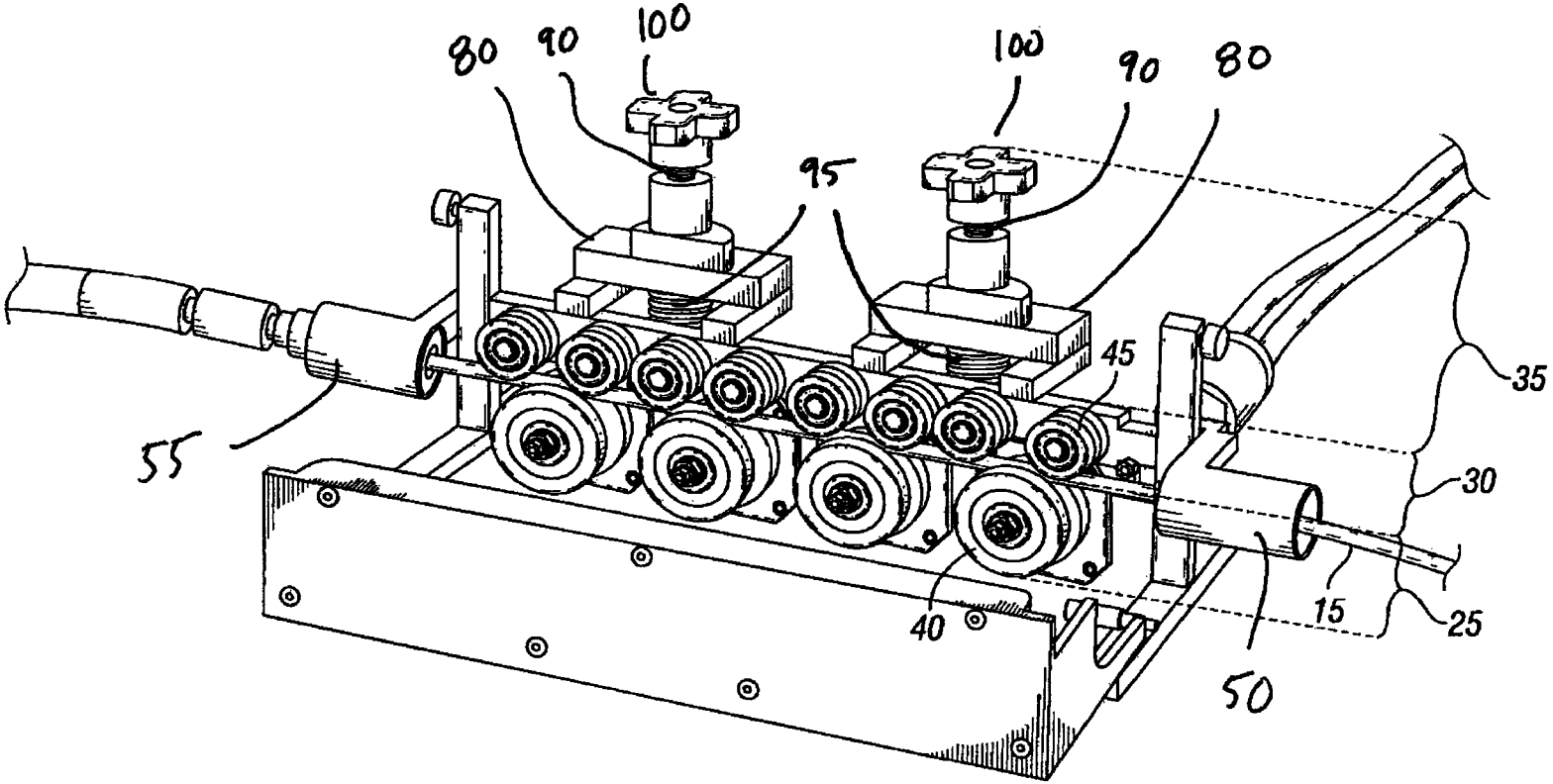
FIG. 6B is a front perspective view of a driving apparatus with the drive wheels and idler wheels engaged together in an illustrative embodiment.
Figure 6C:
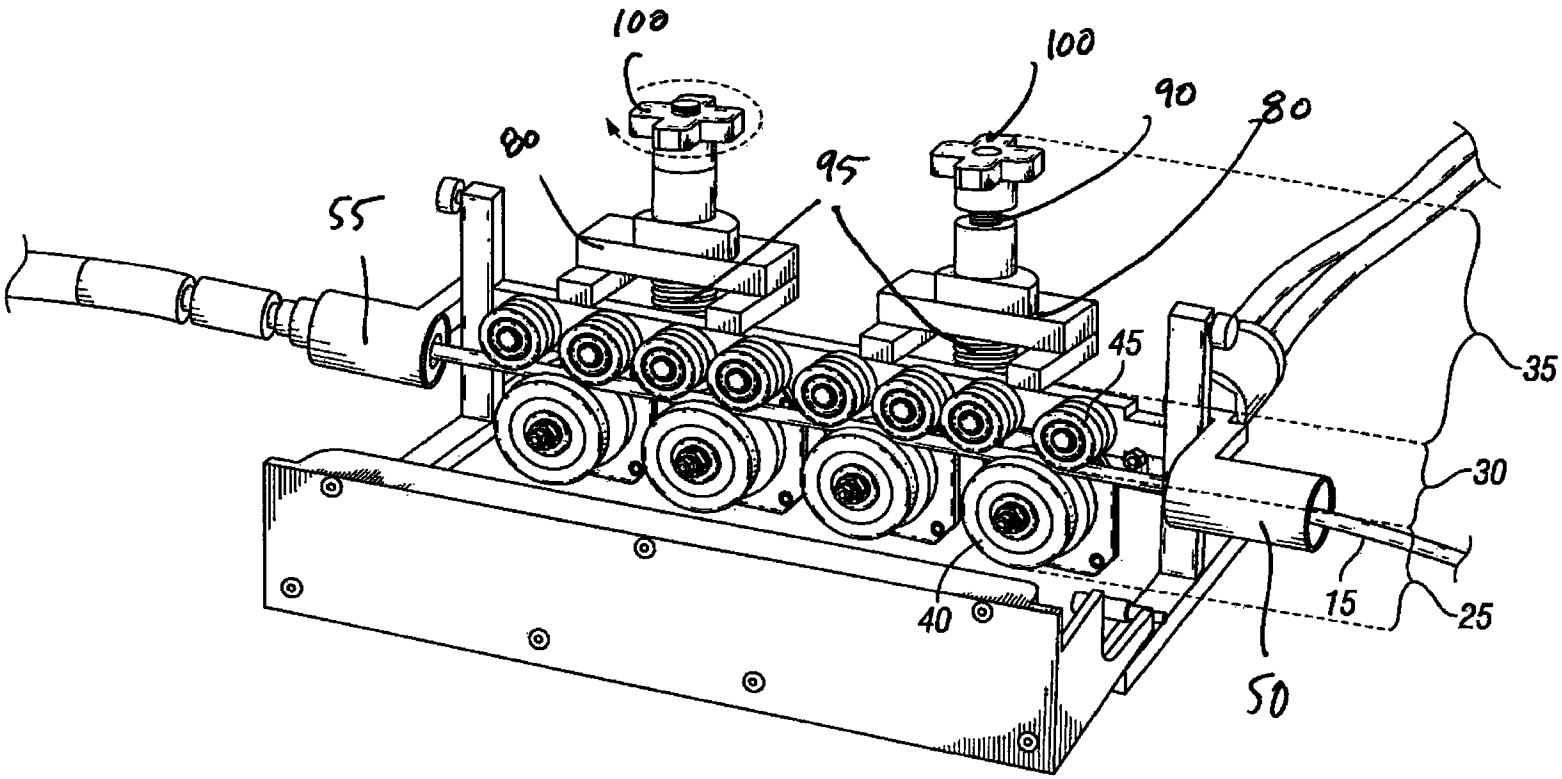
FIG. 6C is a front perspective view of a driving apparatus with an adjustment knob in a tightened position in an illustrative embodiment.

One or more adjustment units 35 can be disposed adjacent to idler unit 30, and can be utilized to tighten and secure cleaning lance 15 between drive wheels 40 and idler wheels 45 when idler unit 30 is in the spaced together, lowered or closed position. For example, as illustrated in FIGS. 6A-6C, idler unit 30 can have one or more adjustment plates 80 attached thereto. A slider post 90 can be sized to fit within an opening in adjustment plate 80, and a slider post adjustment knob 100 can be disposed on slider post 90. A spring 95 can surround each slider post 90.

In an illustrative embodiment, when idler unit 30 is in the raised or open position (FIG. 6A), springs 95 are preferably in an expanded state and cleaning lance 15 can be placed between drive wheels 40 and idler wheels 45. When idler unit 30 is moved to the "lowered" or "closed" position (FIG. 6B), slider post 90 is exposed. Slider post adjustment knob 100 can be tightened onto slider post 90 (FIG. 6C) to compress spring 95. As each slider post adjustment knob 100 is tightened, the distance between drive wheels 40 and idler wheels 45 decreases, drive wheels 40 and idler wheels 45 engage and directly contact cleaning lance 15, and pressure is applied to cleaning lance 15. Springs 95 provide tension and resistance against adjustment plate 80. The grip against cleaning lance 15 by drive wheels 40 and idler wheels 45 is not so tight as to unnecessarily restrict movement of cleaning lance 15 towards or away from exchanger 20 or other equipment during operation of driving apparatus 10.

Figure 7A:
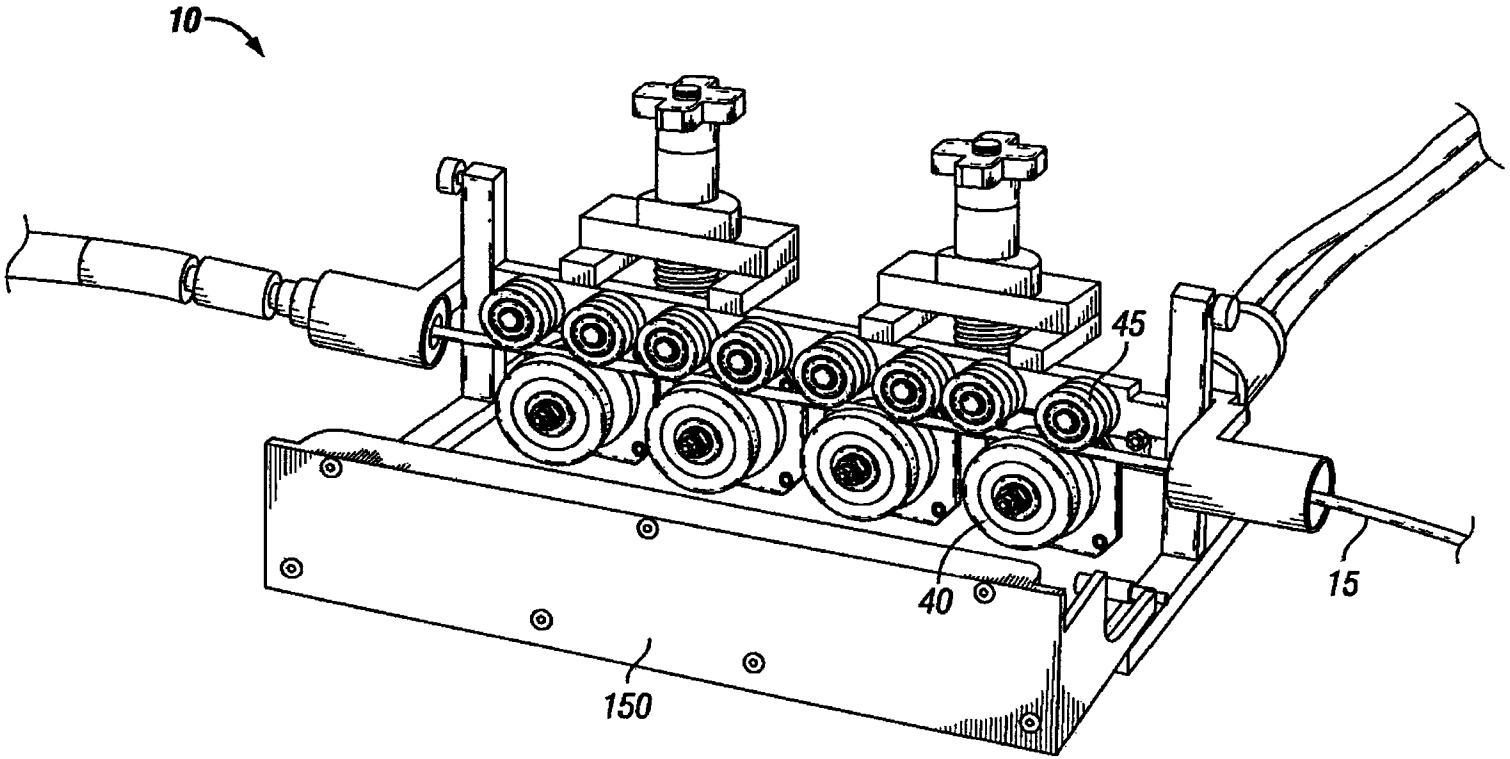
FIG. 7A is a front perspective view of a driving apparatus with a wheel guard in a open position in an illustrative embodiment.
Figure 7B:
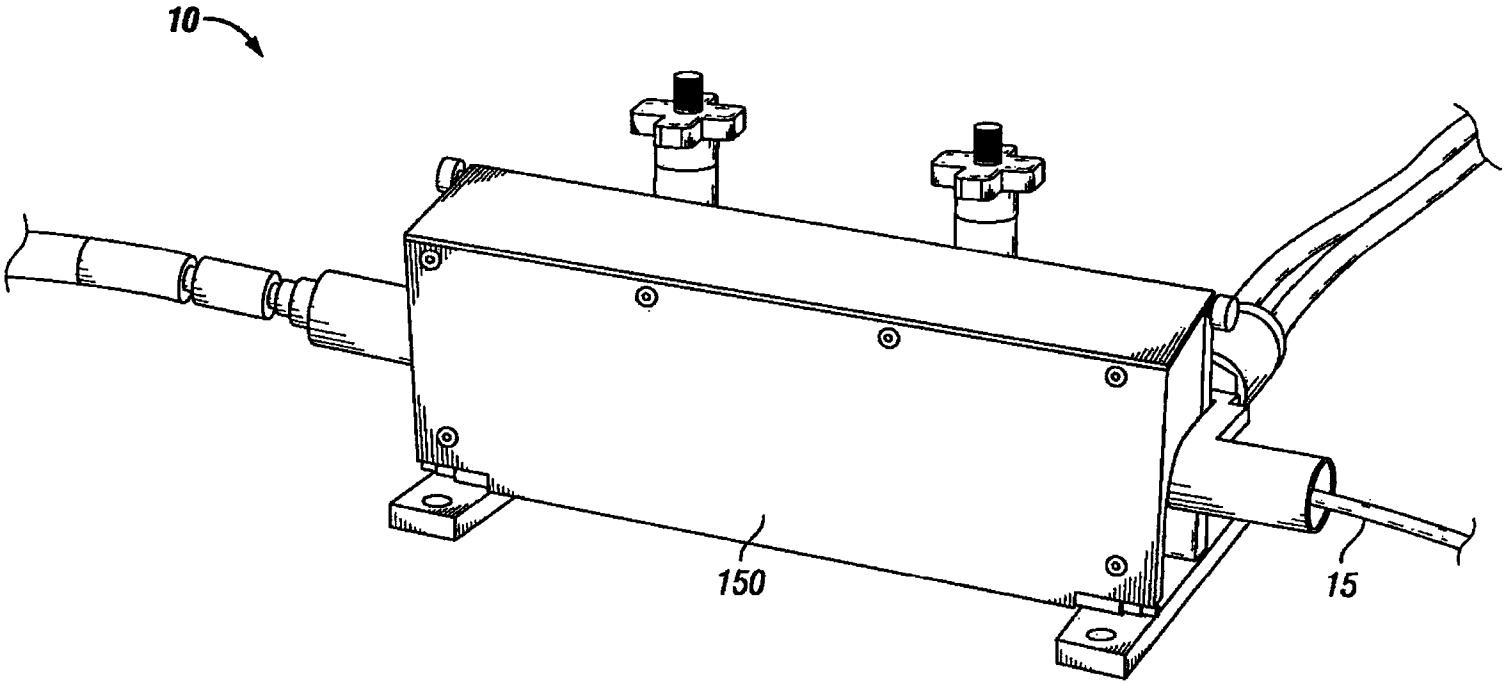
FIG. 7B is a front perspective view of a driving apparatus with a wheel guard in a closed position in an illustrative embodiment.
Figure 8B:
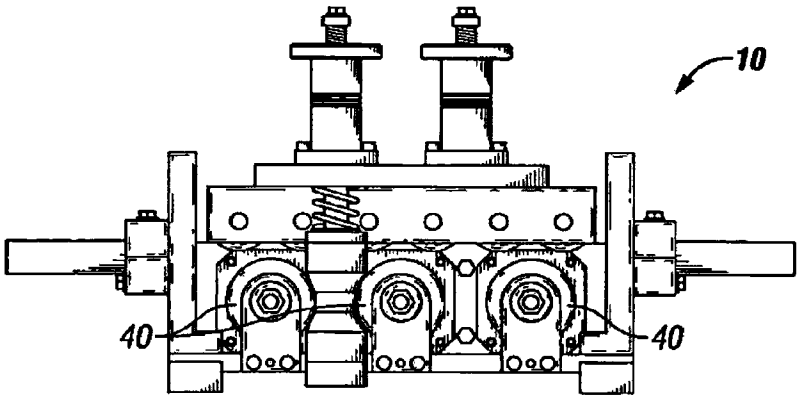
FIGS. 8A-8C are views of a driving apparatus capable of controlling the movement of multiple cleaning lances in an illustrative embodiment.
Figure 8C:
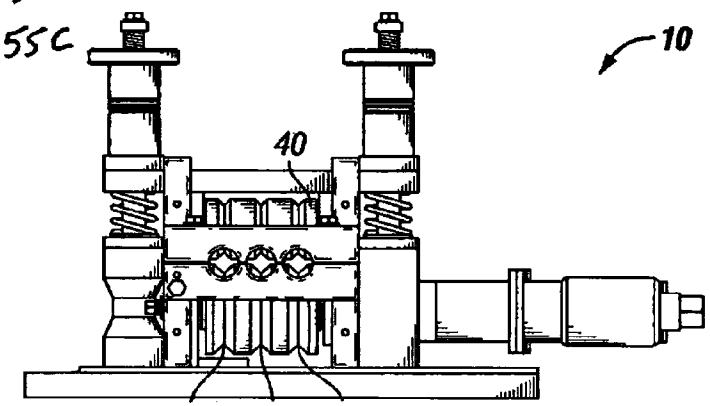
Figure 8A:
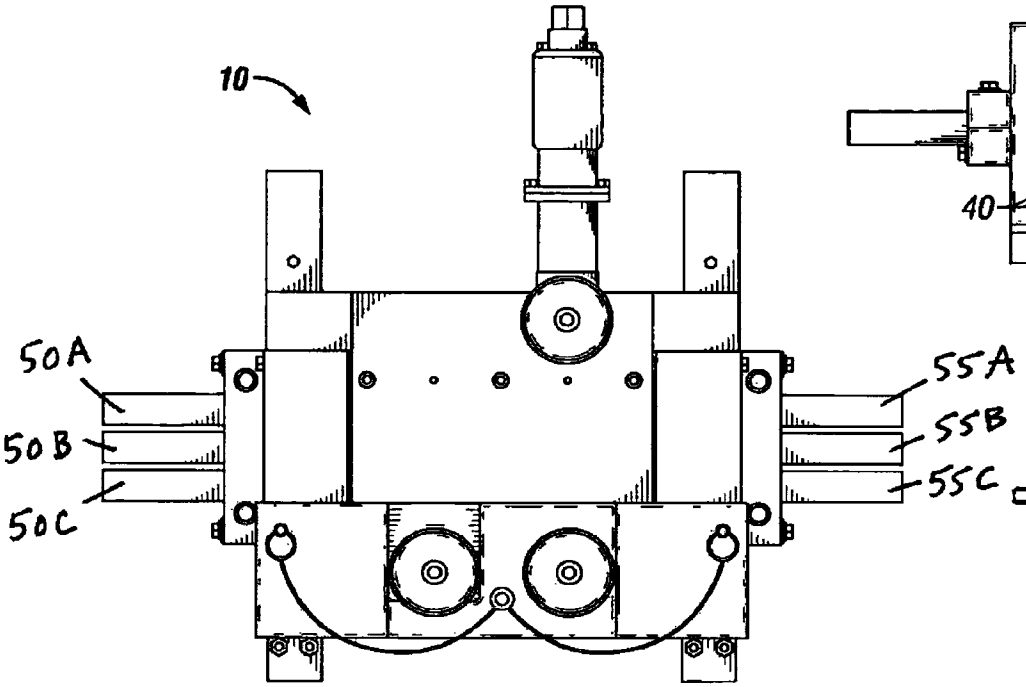
Figure 9:
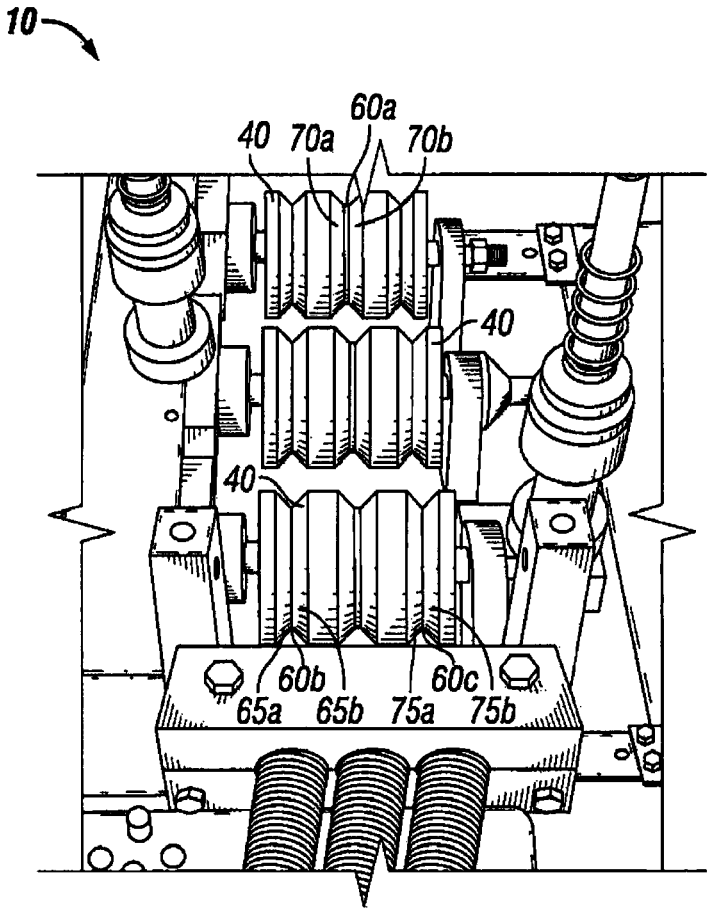
FIG. 9 is a top view of a driving apparatus having drive wheels with a plurality of channels formed therein for holding multiple cleaning lances in an illustrative embodiment.

As illustrated in FIGS. 7A-7B, a wheel guard 150 may be utilized to cover and protect drive wheels 40 and idler wheels 45. Wheel guard 150 can preferably rotate on one or more hinges so that it can be raised or lowered as needed. In FIG. 7A, wheel guard 150 is in the open position, and in FIG. 7B, wheel guard 150 is in the closed position.

In certain illustrative embodiments, driving apparatus 10 can be utilized to control the cleaning movements of a plurality of cleaning lances 15. For example, in the illustrative embodiments shown in FIGS. 8-9, three channels 60*a*, 60*b* and 60*c* are formed in drive wheel 40; however, any number of channels 60 can be utilized in accordance with the present illustrative embodiments. Thus, a single drive wheel 40 can have multiple channels 60 and thus hold multiple cleaning lances 15. Each of channels 60*a*, 60*b* and 60*c*, respectively, can hold its own cleaning lance 15. For example, in certain illustrative embodiments, channels 60*a*, 60*b* and 60*c* can include retaining walls 65*a* and 65*b*, 70*a* and 70*b*, and 75*a* and 75*b*, respectively, that can be used to hold and guide cleaning lances 15A, 15B and 15C (not shown) as they are being advanced towards, or retracted from, exchanger 20.

Driving apparatus 10 can have a plurality of front hose guides 50A, 50B and 50C and a plurality of rear hose guides 55A, 55B and 55C to guide lances 15A, 15B and 15C (not shown), respectively. One or more of lances 15A, 15B and 15C may also have a mechanical stop (not shown) disposed thereupon, such that if the mechanical stop contacts apparatus 10, the lance 15 having the stop will no longer advance or retract, but the other lances 15 will continue to advance or retract with respect to exchanger 20.

Advantageously, cleaning lance 15 is not clamped or otherwise retained onto driving wheel 40 or idler wheel 45, or within channel 60. Instead, lance 15 is capable of slipping along the surface of driving wheel 40 and/or idler wheel 45 while drive wheel 40 and/or idler wheel 45 continue to rotate. Further, drive wheel 40 and/or idler wheel 45 do not completely or substantially surround lance 15 or contact lance 15 along its entire length within apparatus 10. Driving apparatus 10 does not require any unnecessary reassembly or exchanging of parts, and can provide sufficient grip and pressure on cleaning lance 15 while preventing unnecessary slippage. Driving apparatus 10 is easy to use in the field. In certain illustrative embodiments, apparatus 10 has a complete sealed gearbox with no grease fittings. Further, drive wheels 40 are the only wear item, and can be changed easily.

In certain illustrative embodiments, drive wheels 40 and/or idler wheels 45 may be covered, or partially covered, with a belt to form a conveyer track, which would allow for additional surface area to contact cleaning lance 15.

It is to be understood that the subject matter is not limited to the exact details of construction, operation, exact materials, or illustrative embodiments shown and described, as modifications and equivalents will be apparent to one skilled in the art. Accordingly, the subject matter is therefore to be limited only by the scope of the appended claims.

What is claimed is:

1. An apparatus for advancing a cleaning lance, the apparatus comprising:

a drive unit having a drive wheel, the drive wheel having at least one channel that engages the cleaning lance;

an idler unit having at least one idler wheel;

an opening between the drive wheel and the at least one idler wheel such that the cleaning lance is positionable along a linear axis in the opening;

a contact surface on the at least one idler wheel for contacting the cleaning lance and applying pressure to the cleaning lance; and a contact surface on the at least one channel for contacting the cleaning lance and applying frictional force to the cleaning lance such that the cleaning lance is bent by the pressure from the at least one idler wheel on a radius around the drive wheel and advanced upon rotational movement of the drive wheel, wherein the contact surface of the at least one channel and the contact surface of the at least one idler wheel grip the cleaning lance therebetween in a manner whereby the drive wheel will continue to rotate while slipping against the cleaning lance upon encountering an obstruction and then will advance the cleaning lance when the obstruction is cleared.

2. The apparatus of claim 1, wherein the channel includes retaining walls each having a lower end, and wherein the retaining walls meet at the respective lower ends and form a V shape having an angle therebetween.

3. The apparatus of claim 1, wherein the channel comprises a single curved wall.

4. The apparatus of claim 1, wherein the idler unit is adjustable between an elevated position and a lowered position, whereby the cleaning lance sits in the opening between the drive wheel and the at least one idler wheel when the idler unit is in the elevated position, and the drive wheel and the at least one idler wheel contact the cleaning lance when the idler unit is in the lowered position.

5. A method of advancing a cleaning lance, the method comprising:

providing a drive wheel capable of rotational movement, the drive wheel having a contact surface;

providing at least one rotatable wheel capable of rotational movement, the at least one rotatable wheel having a contact surface;

positioning the cleaning lance along a linear axis in an opening between the drive wheel and the at least one rotatable wheel;

contacting the cleaning lance with the contact surface of the rotatable wheel and applying pressure to the cleaning lance;

contacting the cleaning lance with the contact surface of the drive wheel and applying frictional force to the cleaning lance such that the cleaning lance is bent by the pressure from the at least one rotatable wheel on a radius around the drive wheel, the drive wheel grips the cleaning lance, and the cleaning lance is advanced upon rotational movement of the drive wheel;

continuing the rotational movement of the drive wheel upon the cleaning lance encountering an obstruction to advancement, such that the contact surface of the drive wheel slips against the cleaning lance;

removing or substantially removing the obstruction to advancement with the cleaning lance;

continuing the rotational movement of the drive wheel and regripping the cleaning lance with the contact surface of the drive wheel; and continuing the advancement of the cleaning lance.

6. A method of removing an obstruction in a heat exchanger tube using a cleaning lance, the method comprising:

providing a rotatable wheel capable of rotational movement powered by a power source, the drive wheel having a contact surface;

providing an rotatable wheel capable of rotational movement caused by direct contact with the cleaning lance, the rotatable wheel having a contact surface;

contacting a contact surface of the cleaning lance with the contact surface of the drive wheel and the contact surface of the rotatable wheel;

applying frictional force to the contact surface of the cleaning lance upon rotational movement of the drive wheel such that the contact surface of the drive wheel grips the contact surface of the cleaning lance and the cleaning lance rotationally moves the rotatable wheel and is advanced towards the obstruction in the heat exchanger tube;

engaging the obstruction in the heat exchanger tube;

continuing the rotational movement of the drive wheel while the cleaning lance engages the obstruction, such that the contact surface of the drive wheel slips against the contact surface of the cleaning lance;

removing or substantially removing the obstruction from the heat exchanger tube; and applying frictional force to the cleaning lance upon rotational movement of the drive wheel such that the contact surface of the drive wheel regrips the contact surface of the cleaning lance and the cleaning lance is moved with respect to the heat exchanger tube.

7. The method of claim 6, wherein the power source is a motor.

8. The method of claim 6, wherein the power source is an electrical power source.

9. The apparatus of claim 1, wherein the drive unit has a single drive wheel such that the at least one rotatable wheel is offset with the single drive wheel.

10. The apparatus of claim 9, wherein the offset is approximately 15 degrees.

11. The apparatus of claim 1, wherein the drive unit has a plurality of drive wheels disposed thereon, and each drive wheel has at least two rotatable wheels positioned adjacent to and offset from the drive wheel.

12. An apparatus for advancing a cleaning lance, the apparatus comprising:

a drive unit having a drive wheel disposed thereon;

a rotatable unit having at least one rotatable wheel disposed thereon;

an opening between the drive wheel and the at least one rotatable wheel such that the cleaning lance is positionable along a linear axis in the opening;

a contact surface on the at least one rotatable wheel for contacting the cleaning lance and applying pressure to the cleaning lance; and a contact surface on the drive wheel for contacting the cleaning lance and applying frictional force to the cleaning lance such that the cleaning lance is bent by the pressure from the at least one rotatable wheel on a radius around the drive wheel and advanced upon rotational movement of the drive wheel, wherein the contact surface on the drive wheel is structured to slip against the cleaning lance upon encountering an obstruction, and is further structured to regrip the cleaning lance thereafter.

13. The apparatus of claim 12, wherein the drive unit has a single drive wheel such that the at least one rotatable wheel is offset with the single drive wheel.

14. A method of advancing a cleaning lance, the method comprising:

providing a drive wheel capable of rotational movement, the drive wheel having a contact surface;

providing at least one rotatable wheel capable of rotational movement, the at least one rotatable wheel having a contact surface;

positioning the cleaning lance on a linear axis in an opening between the drive wheel and the at least one rotatable wheel;

contacting the cleaning lance with the contact surface of the at least one rotatable wheel and applying pressure to the cleaning lance;

contacting the cleaning lance with the contact surface of the drive wheel and applying frictional force to the cleaning lance such that the cleaning lance is bent by the pressure from the at least one rotatable wheel on a radius around the drive wheel, the drive wheel grips the cleaning lance, and the cleaning lance is advanced upon rotational movement of the drive wheel;

continuing the rotational movement of the drive wheel upon the cleaning lance encountering an obstruction to advancement, such that the contact surface of the drive wheel slips against the cleaning lance;

removing or substantially removing the obstruction to advancement with the cleaning lance;

continuing the rotational movement of the drive wheel and regripping the cleaning lance with the contact surface of the drive wheel; and continuing the advancement of the cleaning lance.

15. The apparatus of claim 12, further comprising a front hose guide and a rear hose guide, wherein the front hose guide and the rear hose guide receive opposite ends of the cleaning lance when the cleaning lance is positioned along a linear axis in the opening.

16. A method of advancing a plurality of cleaning lances, the method comprising:

providing a drive wheel capable of rotational movement, the drive wheel having a contact surface;

providing at least one rotatable wheel capable of rotational movement, the at least one rotatable wheel having a contact surface;

positioning the cleaning lances on a linear axis in an opening between the drive wheel and the at least one rotatable wheel;

contacting the cleaning lances with the contact surface of the at least one rotatable wheel and applying pressure to the cleaning lances;

contacting the cleaning lances with the contact surface of the drive wheel and applying frictional force to the cleaning lance such that the drive wheel grips the cleaning lances and the cleaning lances are advanced upon rotational movement of the drive wheel;

continuing the rotational movement of the drive wheel upon the cleaning lances encountering an obstruction to advancement, such that the contact surface of the drive wheel slips against the cleaning lances;

removing or substantially removing the obstruction to advancement with the cleaning lances;

continuing the rotational movement of the drive wheel and regripping the cleaning lances with the contact surface of the drive wheel; and continuing the advancement of the cleaning lances.

17. The apparatus of claim 16, wherein the plurality of cleaning lances have a diameter in the range from ⅛" to 9/16".

18. The apparatus of claim 17, wherein the plurality of cleaning lances have a diameter of at least 1/16".

* * * * *